United States Patent [19]

Ellen

[11] 4,023,318

[45] May 17, 1977

[54] CONCRETE STRUCTURES

[76] Inventor: Peter Edington Ellen, 16 Cornwall Ave., Turramurra 2074, Sydney, Australia

[22] Filed: Feb. 10, 1976

[21] Appl. No.: 656,948

[30] Foreign Application Priority Data

Feb. 13, 1975 Australia ..... 0597/75

[52] U.S. Cl. ..... 52/231; 52/259; 52/263; 52/745

[51] Int. Cl.[2] ..... E04C 3/20; E04B 1/18

[58] Field of Search ..... 52/259, 260, 231, 126, 52/745, 263

[56] References Cited

UNITED STATES PATENTS

| | | | |
|---|---|---|---|
| 1,461,892 | 7/1923 | Coney | 52/260 |
| 3,380,209 | 4/1968 | Cheskin | 52/231 |

FOREIGN PATENTS OR APPLICATIONS

| | | | |
|---|---|---|---|
| 659,185 | 3/1963 | Canada | 52/745 |

*Primary Examiner*—Price C. Faw, Jr.
*Assistant Examiner*—James L. Ridgall, Jr.
*Attorney, Agent, or Firm*—Michael J. Striker

[57] ABSTRACT

A concrete structure in which a post-tensioned concrete slab is supported by columns, each column being surrounded or partly surrounded by an area of concrete in the form of a hollow inverted pyramid, the column passing through the apex of the pyramid. The area concerned is formed integrally with the remainder of the slab and is of substantially uniform thickness sloping downwardly from the surrounding concrete towards the column at an angle $\theta$ to the horizontal such that tan $\theta$ lies in the range of 0.1 to 0.25 or in the case of a column near an edge or corner of the structure 0.1 to 0.35. The area is bounded by a system of reinforcing post-tensioned members passing through the slab which lies within a strip thickness of the slab, the crack spacing of the concrete surrounding the post-tensioned members in that strip at ultimate strength being not more than 18 inches and preferably within the range of 6 to 10 inches and the strength of the concrete in a section at the face of the column being between 1.3 and 2.0 of the resultant tension component of the surrounding post-tensioned members at ultimate strength. A combination of the foregoing characteristics provides a structure which enables the spacing between adjacent columns to be increased in relation to the spacing required in known comparable forms of construction.

5 Claims, 5 Drawing Figures

CONCRETE STRUCTURES

BACKGROUND OF THE INVENTION

The present invention relates to post-tensioned concrete structures and more particularly to a construction for use in the support of post-tensioned slabs or shell like structures by means of columns and has for its object the provision of a form of construction which enables the spacing between columns to be increased in relation to the spacing required in known comparable forms of construction, thus achieving a saving in building costs, while ensuring the stability of the structure.

SUMMARY OF THE INVENTION

The invention consists in a structure in which a post-tensioned concrete slab is supported by columns the support in the case of each column being through an area of reinforced concrete forming part of the slab, which wholly or in the case of a column near an edge or corner of the slab, partly, surrounds the column, the area being in the form of a hollow inverted pyramid or in the case of a column near an edge or corner of the slab a part of a hollow inverted pyramid the column passing through the apex of the pyramid or part pyramid. This area is formed integrally with the remainder of the slab, is of substantially uniform thickness and slopes downwardly from the surrounding concrete towards the column at an angle to the horizontal such that tan $\theta$ lies in the range of 0.1 to 0.25 or in the case of a column near an edge or corner of the structure 0.1 to 0.35. The area is bounded on each side by a post-tensioned member or members passing through the slab, the member or members lying within a strip lying adjacent the area and being not wider than 10 to 12 times the thickness of the slab. The crack spacing of the concrete surrounding the post-tensioned member or members in the strip at ultimate strength is not more than 18 inches and preferably within the range of 6 to 10 inches. The strength of the concrete in a section at the face of the column is between 1.3 and 2.0 of the resultant tension component of the surrounding post-tensioned member or members at ultimate strength to avoid excessive deflection and unbalance in thrust lines.

The term "column" includes a pair or more of closely spaced columns. the term "slab" includes a slab having curved surfaces.

BRIEF DESCRIPTION OF THE DRAWING

In order that the invention may be better understood and put into practice a preferred form thereof is hereinafter described by way of example with reference to the accompanying diagrammatic drawings in which.

DESCRIPTION OF THE PREFERRED EMBODIMENT

In the preferred form of the invention it is applied to the construction of a "lift slab" building in which support columns are erected and the various floors of the building are cast one on top of another at ground level and thereafter lifted into position by means of jacks and are supported by suitable means affixed to the columns under the floors.

In the application of the invention to such a structure concrete floor slabs are constructed by the use of conventional techniques, each column being surrounded by an area of concrete in the form of a hollow inverted pyramid, the base of which is rectangular and which preferably has sides the length of which are in a ratio of between 1:1 and 1:4. The floor is arranged to slope downwardly from its normal level at the surface of the slab to points adjacent the column at an angle $\theta$ as defined above. Subsequent floors can then be cast one above another so as to have a near uniform thickness not only in its flat portions but in the area surrounding each column. Suitable reinforcing material is arranged in the area around each column and this area is bounded on each side by cables or rods which are post-tensioned after the concrete has set.

Figure 1:
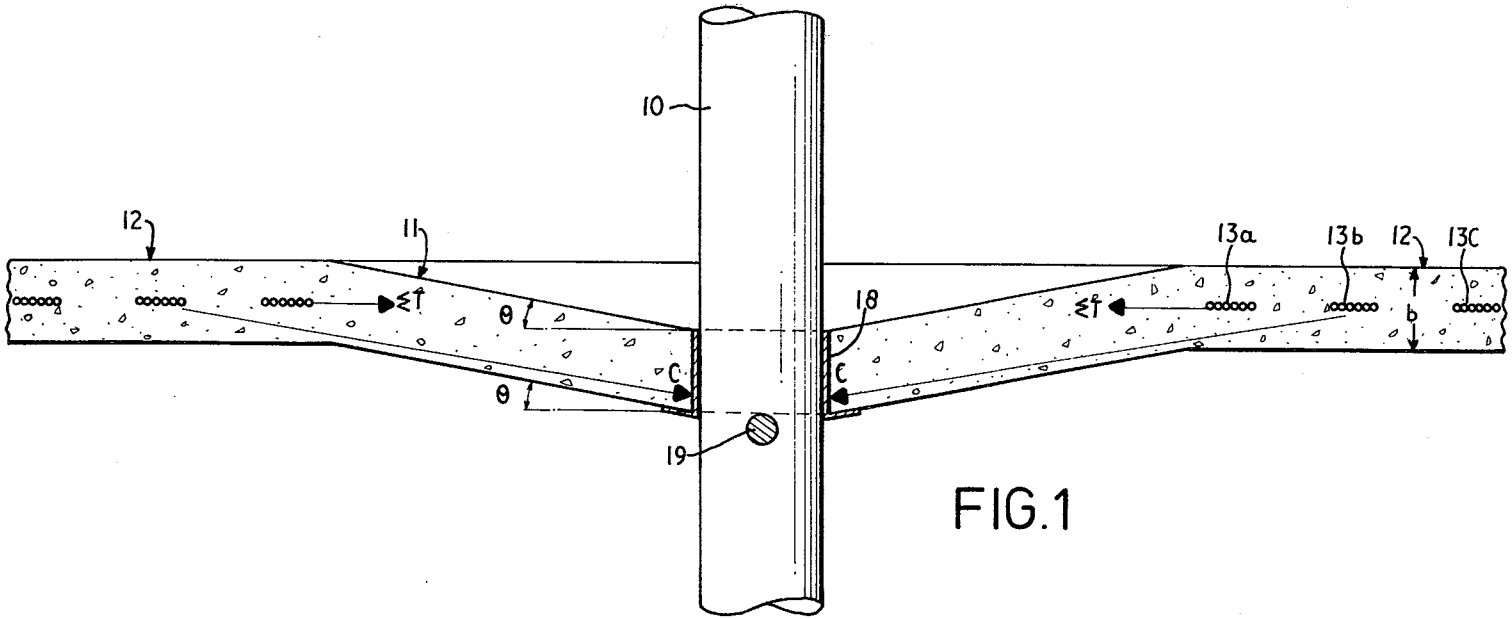
FIG. 1 is a typical sectional view of a portion of a concrete slab surrounding a supporting column.
Figure 2:
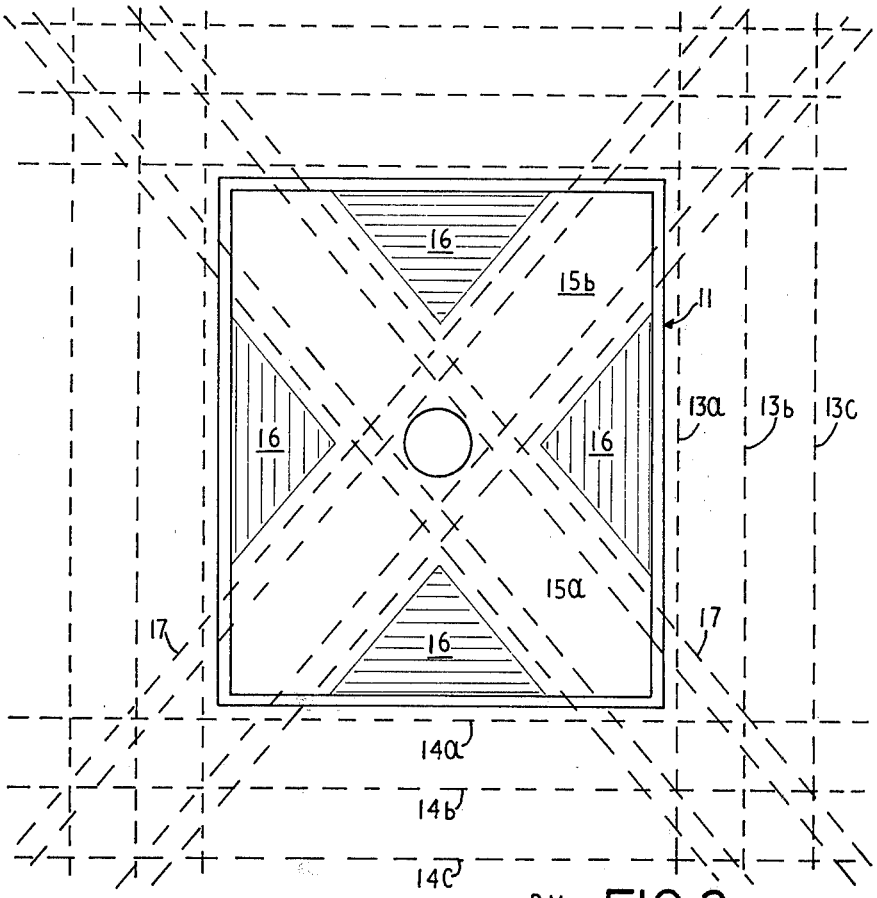
FIG. 2 is a plan view of the area of the slab surrounding a supporting column.

In FIGS. 1 and 2 a steel column 10 is surrounded by a rectangular area 11 of concrete in the form of a hollow inverted pyramid sloping at an angle $\theta$, which forms part of a concrete slab 12 of uniform thickness and having a flat surface except in areas similar to the area 11 surrounding other columns.

The area of concrete 11 is surrounded by groups 13*a*, 13*b*, 13*c* and 14*a*, 14*b* and 14*c* of post-tensioned cables which together exert a tension force T along the diagonal of the area of concrete 11. Each group of cables must lie within a strip commencing at the edge of the area 11 which is not wider than 10 to 12 times the slab thickness T.

The strength of the concrete used is that normally used for such structures and its compressive strength should be able to support compressive forces which will result from slab compressive stresses ranging from 300 P.S.I. to in excess of 15,000 P.S.I.

Considerable theoretical and practical studies have shown that if the advantages of the type of construction concerned are to be optimized without compromising the strength and stability of the structure it is essential that the relationships set out above must be observed in the design of the structure.

Firstly the slope of the inverted pyramid shape must be within the limits stated so that the force component C acting through the sloping portions of the inverted pyramid towards the supporting column 10 must lie at an angle $\theta$ such that tan $\theta'$ lies within the range 0.15 to 0.25 at the face of the column 10. It has been found that effective support of the slab in the area of the inverted pyramid is due to diagonal strips of concrete 15*a* and 15*b* extending from corner to corner of the area and having a width of between 0.35 to 0.45 L and preferably approximately 0.42 L where L is the mean of the length of the sides $L_1$ and $L_2$ of the area and it is in these strips that the force component C referred to above acts. The shaded triangular areas 16 of FIG. 1 are areas in which cracking will take place at ultimate load and in theory concrete in these areas could be omitted. In practice if it is necessary to pass pipes through the slab it is preferable to form the necessary apertures in these areas.

The ultimate tension forces surrounding the pyramidal area must be composed of at least 60% of post-tensioned cables 13*a,b,c*, and 14*a,b,c*, having a bond length to control concrete cracking within the range of 6 18 inches and preferably within the range of 6 to 10 inches. Wider crack spacing than 18 inches will lead to excessive strains and premature failure; techniques for controlling crack spacing are well known in the art. The residual forces may be deformed bar reinforcement bonded at half distances between adjacent columns beyond the edges of the pyramidal areas.

The strength of the concrete in the diagonal support thrust strips 15*a* and 15*b* at the face of the column 10 must be 1.3 to 2 time the resultant tension component T of the surrounding cables at ultimate strength. Putting this another way in the limiting case tension around the pyramidal area must not exceed 50% to 60% of the strength of the concrete thrust members constituted by the diagonal strips 15*a* and 15*b* which have a width of between 0.35 and 0.45 and in the particular case illustrated 0.42L. Steel reinforcement in the form of thrust bars 17 is preferably included in the strips 15*a* and 15*b* as shown in FIG. 2.

The combination of the design features described above results in the control of concrete strain in the compression strips described above by the width and slope thereof at the column interface, the specified crack spacing of the tension components about the pyramidal area acting to transfer the loads into the compression strips by the use of the correct slope for the sloping portions of the pyramid.

In the construction of a building having a number of floors, when the concrete of the first floor has set the next floor may be cast over it in the same manner, utilising the depressions in the first floor to form similar depressions in the second and subsequent floors which may then be cast one after the other in the same manner. Subsequently the floors are lifted into their final positions in a conventional manner and supported from the columns also in a conventional manner and supported from the columns also in a conventional manner such as by a collar 18 and pin 19 (FIG. 1). It should be noted that when the floors are still one on top of another the effect of stressing each floor, slightly changes the shape of the inverted pyramid which assists in freeing it from the floor below.

Once in position the pyramidal depressions may be back filled with reinforced concrete. This assists in fixing the slabs rigidly to the columns and assists in accepting sideway loads such as those produced by winds or earthquakes.

Figure 4:
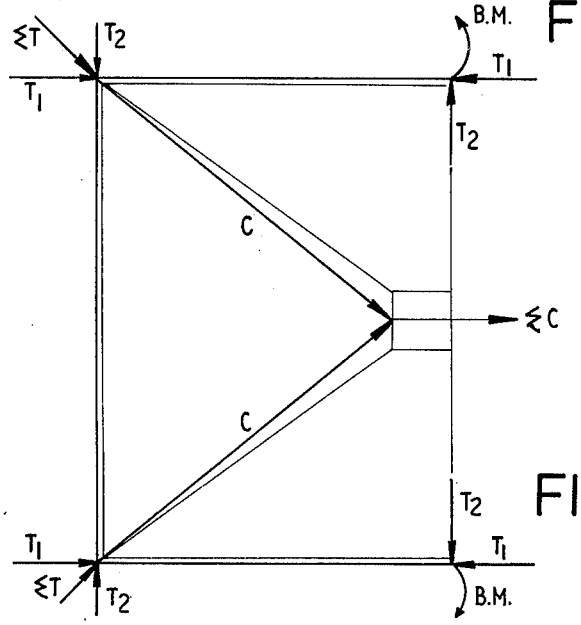
FIG. 4 is a diagram indicating the forces acting in a arrangement illustrated in FIG. 3 and, FIG. 5 illustrates the manner in which the invention may be applied to a sloping slab.
Figure 3:
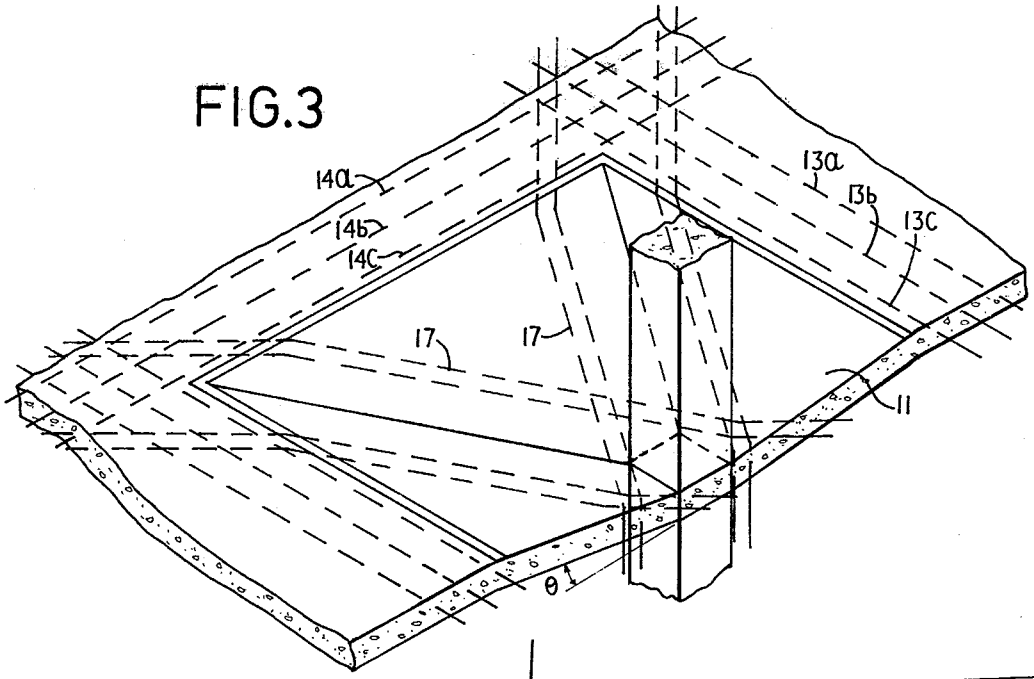
FIG. 3 illustrates the application of the invention to a column at the edge of a slab.

Columns near the edges of the slabs are treated in exactly the same manner as indicated in FIG. 3 except that the pyramidal depression will surround only a part of the column. It can be shown that the out of balance forces under these circumstances are balanced by the stressing cables passing along the sides of the part pyramidal area. In the case of half columns tan $\theta'$ should be between 0.1 and 0.35. The forces acting in a typical case are illustrated in FIG. 4. The cables passing around each side of the area 11 provide the components T to hold the tension component of the structure; the resulting compression thrust C is balanced by cable forces $T_1$ the cables being anchored at the edge of the concrete slab 12 in a conventional manner. The splitting component $T_2$ is restrained by the bending moment B.M. of the slab at the edges of the area 11 and is also held by the cable forces $T_1$.

Where out of balance forces exist in any pyramidal area due to the nature of the structure any out of balance moments produced by these may be balanced by the use of slab or slab like beam cables adjoining each pyramidal area. Further lateral forces due to sideway or earthquake loads or due to loads from heavy applied forces due to live loading may be further controlled by "cap" cables which pass through the infill concrete and the pyramidal area in an arcuate path being upwardly curved in the pyramidal area in an arcuate path.

It should be noted that in place of a single column at the centre of the inverted pyramid a pair or more of closely spaced columns may be used.

Figure 5:
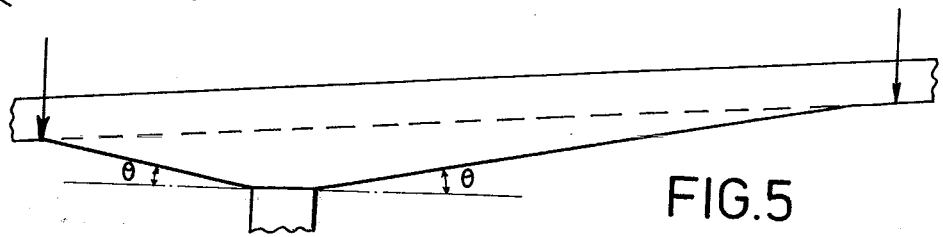

The invention may be applied in the construction of a sloping slab as illustrated in FIG. 5 the design of such a structure being similar to that of a flat slab except that the respective length of the sloping faces of the inverted pyramid must be modified to take an account of the slope and to balance the forces about the column.

While it is not proposed to deal in this specification with the theoretical justification for the construction described, it can be shown, and it has been demonstrated in experimental structures, that the use of the invention enables a larger area of slab to be supported by fewer columns than with conventional forms of construction under similar circumstances, provided that the angle of the inverted pyramid is within the range given above so that the cables surrounding the pyramidal area are supported by the internal thrust slope of the concrete and the other conditions specified above are met.

The invention is applicable in a variety of different forms of structure. It may for example be applied in shell like structures that is to say in structures in which instead of utilising a flat slab a curved concrete slab is used.

I claim:

1. A structure comprising a horizontal concrete slab and a plurality of vertical columns passing through said slab, said slab being formed at at least some of said columns with a depressed region of polygonal outline and having flat triangular sides forming an angle having a tangent equal to between 0.1 and 0.35 with the plane of the slab, said slab being of substantially uniform thickness at and outside said regions, said slab being provided with post-tensioned stressing members in strips surrounding each of said depressed regions and having widths equal to at most 12 times the slab thickness, each of said regions having the shape of an inverted pyramid centered on the respective column, whereby the strength of the concrete of said slab in a section at the face of the column is between 1.3 and 2.0 times the resultant tension component of the surrounding post-tensioned member at ultimate strength to avoid excessive deflection and unbalance in thrust lines.

2. The structure defined in claim 1 wherein said angle has a tangent equal to between 0.1 and 0.25.

3. The structure defined in claim 2 wherein said slab has outer edges and some of said columns are outer columns passing vertically upwardly through said slab at said outer edges, said slab being formed around three sides of each of said outer columns with a polygonal-outline depression and said slab being provided in a strip around three sides of each of said polygonal-outline depressions with a plurality of such post-tensioned members, said polygonal-outline depressions each having three sides forming angles having tangents equal to between 0.10 and 0.35 with the horizontal.

4. The structure defined in claim 2 wherein said regions are rectangular.

5. The structure defined in claim 4 wherein the sides of said regions are in a ratio of between 1:1 and 1:4.

* * * * *